United States Patent [19]

Heumann

[11] 3,989,300

[45] Nov. 2, 1976

[54] FURNITURE CONSTRUCTION WITH REMOVABLE CUSHIONS

[75] Inventor: Jules M. Heumann, San Francisco, Calif.

[73] Assignee: Metropolitan Furniture Manufacturing Co., South San Francisco, Calif.

[22] Filed: Sept. 19, 1973

[21] Appl. No.: 398,635

[52] U.S. Cl. ..... 297/440

[51] Int. Cl.[2] ..... A47C 7/00

[58] Field of Search ..... 297/440, 444; 292/257, 292/65, 66, 67, 57

[56] References Cited

UNITED STATES PATENTS

| | | | |
|---|---|---|---|
| 862,612 | 8/1907 | Courtenay | 292/66 |
| 2,467,664 | 4/1949 | Glenn | 297/443 |
| 2,650,656 | 9/1953 | Ohlsson | 297/440 |
| 2,660,228 | 11/1953 | Reinhold | 297/443 R |
| 2,793,685 | 5/1957 | Spitz | 297/440 |
| 2,965,161 | 12/1960 | Knoll | 297/440 |
| 3,556,592 | 1/1971 | Antoine | 297/444 |
| 3,700,282 | 10/1972 | Rowland | 297/440 |
| 3,704,911 | 12/1972 | Milakovich | 297/440 |

FOREIGN PATENTS OR APPLICATIONS

| | | | |
|---|---|---|---|
| 1,961,153 | 9/1971 | Germany | 297/440 |

*Primary Examiner*—Werner H. Schroeder
*Assistant Examiner*—Doris L. Troutman
*Attorney, Agent, or Firm*—Phillips, Moore, Weissenberger, Lempio & Strabala

[57] ABSTRACT

A furniture construction comprises a rigid frame having seat and back cushions removably mounted thereon. A rearward end of a support member for the seat cushion and a lower end of a support member for the back cushion meet at a common interface which forms an acute angle with respect to the planes of such members. A retaining member is secured on a back side of the support member for the back cushion to upwardly engage a retaining member secured on a back frame. The support member for the seat cushion is releasably attached to a bottom frame to provide the sole mechanical securance for both cushions to the frame.

12 Claims, 13 Drawing Figures

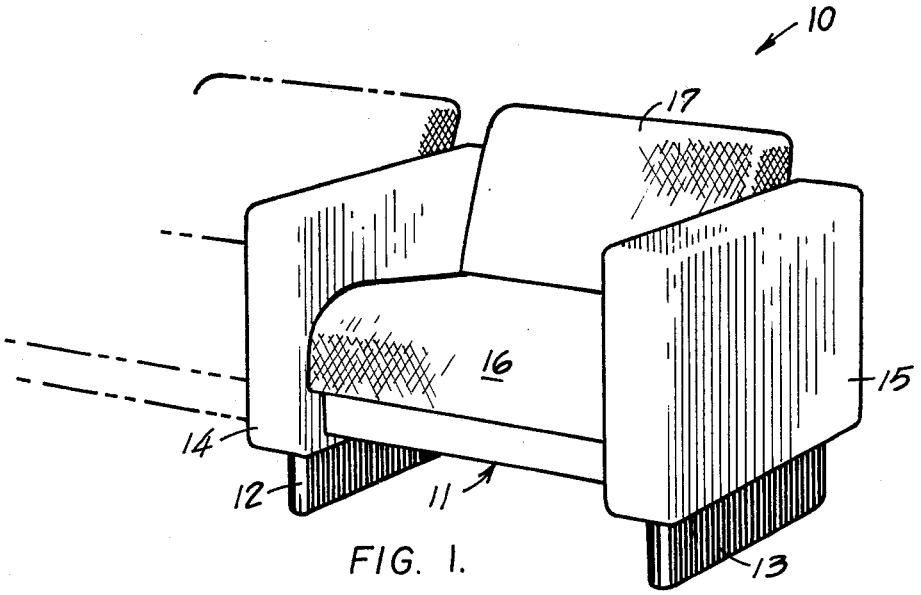
FIG. 1.
FIG. 2.
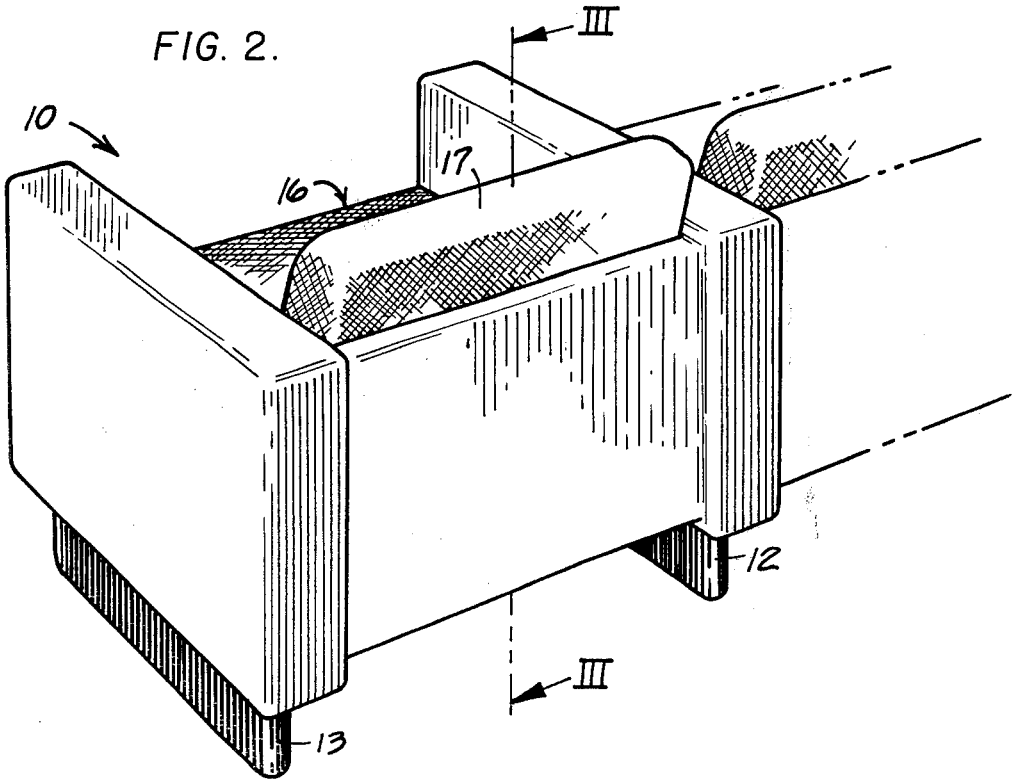

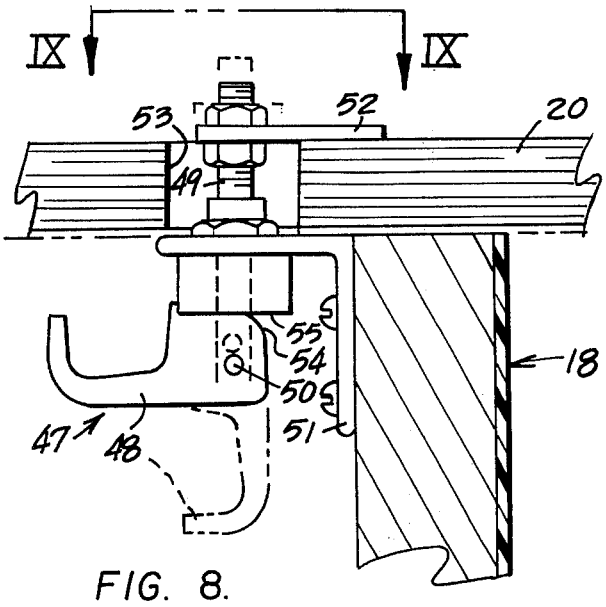
FIG. 8.
FIG. 9.
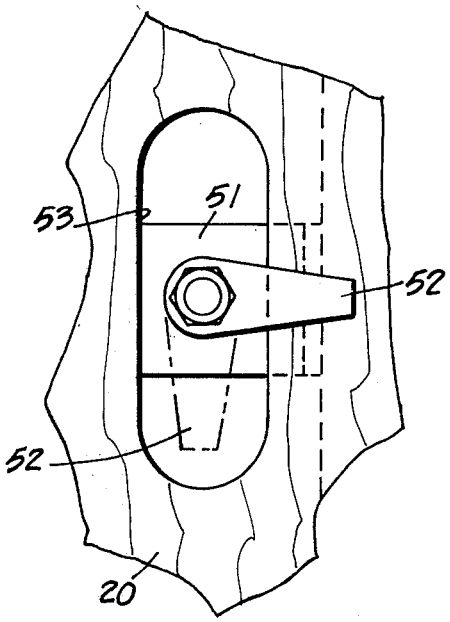
FIG. 4.
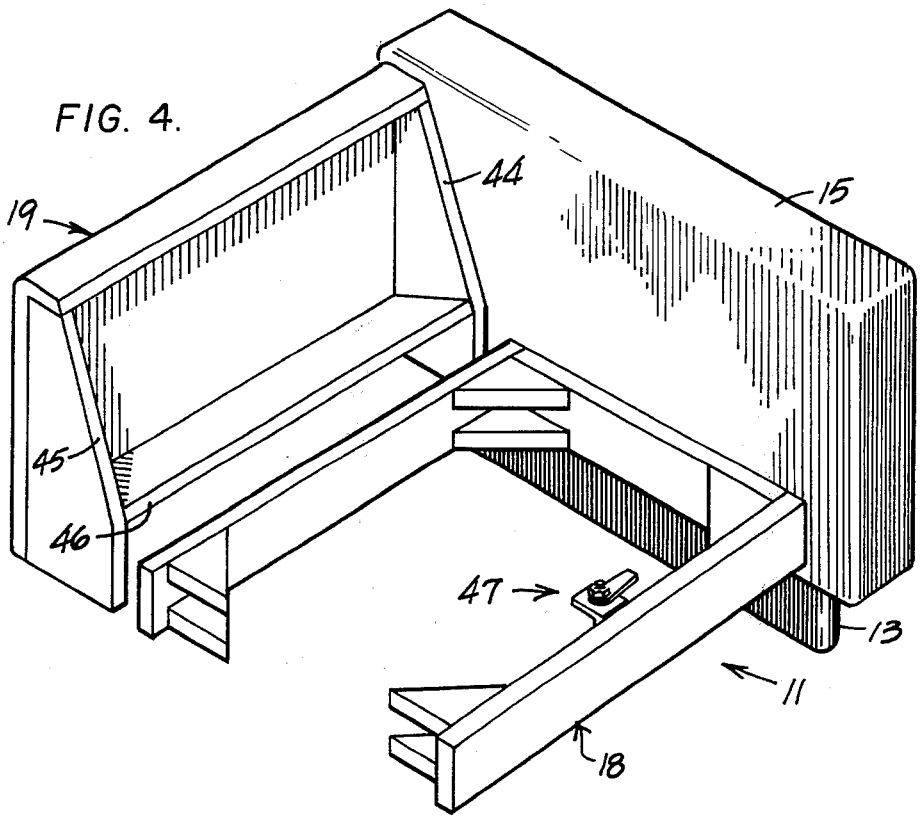

FURNITURE CONSTRUCTION WITH REMOVABLE CUSHIONS

BACKGROUND OF THE INVENTION

The advent of modular type furniture has dictated the need for cushions which can be expeditiously removed therefrom for replacement purposes. Conventional cushions, normally comprising a rigid support member secured thereunder, are normally attached to a rigid frame by fastening means, such as screws or bolts. In addition to greatly increasing production time, replacement of the cushion for repair purposes or the like has proven unduly time-consuming and costly.

Summary of this Invention

An object of this invention is to overcome the above, briefly described problems by providing a non-complex and economical furniture construction comprising seat and back cushions which can be installed and removed expeditiously therefrom. A generally horizontally disposed bottom frame and a generally upright back frame, secured to the bottom frame, respectively mount the seat and back cushions thereon. The cushions each comprise a rigid support member overlying a respective frame, with the back frame having a retaining member disposed adjacent to an upper end thereof. A retaining member, secured on a back side of the support member for the back cushion, engages an underside of the above-mentioned member. In the preferred embodiment, abutting ends of the support members meet at a common interface which forms an acute angle with respect to the plane of each support member. Releasable fastening means solely secure the support member for the seat cushion to the bottom frame.

BRIEF DESCRIPTION OF THE DRAWINGS

Other objects of this invention will become apparent from the following description and accompanying drawings wherein:

FIG. 1 is an end perspective view of a furniture construction embodying this invention:

FIG. 2 is a back side perspective view of the furniture construction;

FIG. 4 is an isometric view of a frame for the furniture construction, with the seat and back cushions and an arm rail removed therefrom;

FIG. 8 is an enlarged sectional view disclosing a clamping device for the seat cushion;

FIG. 9 is a top plan view of the clamping device, taken in the direction of arrows IX—IX in FIG. 8;

DETAILED DESCRIPTION

Figure 3:
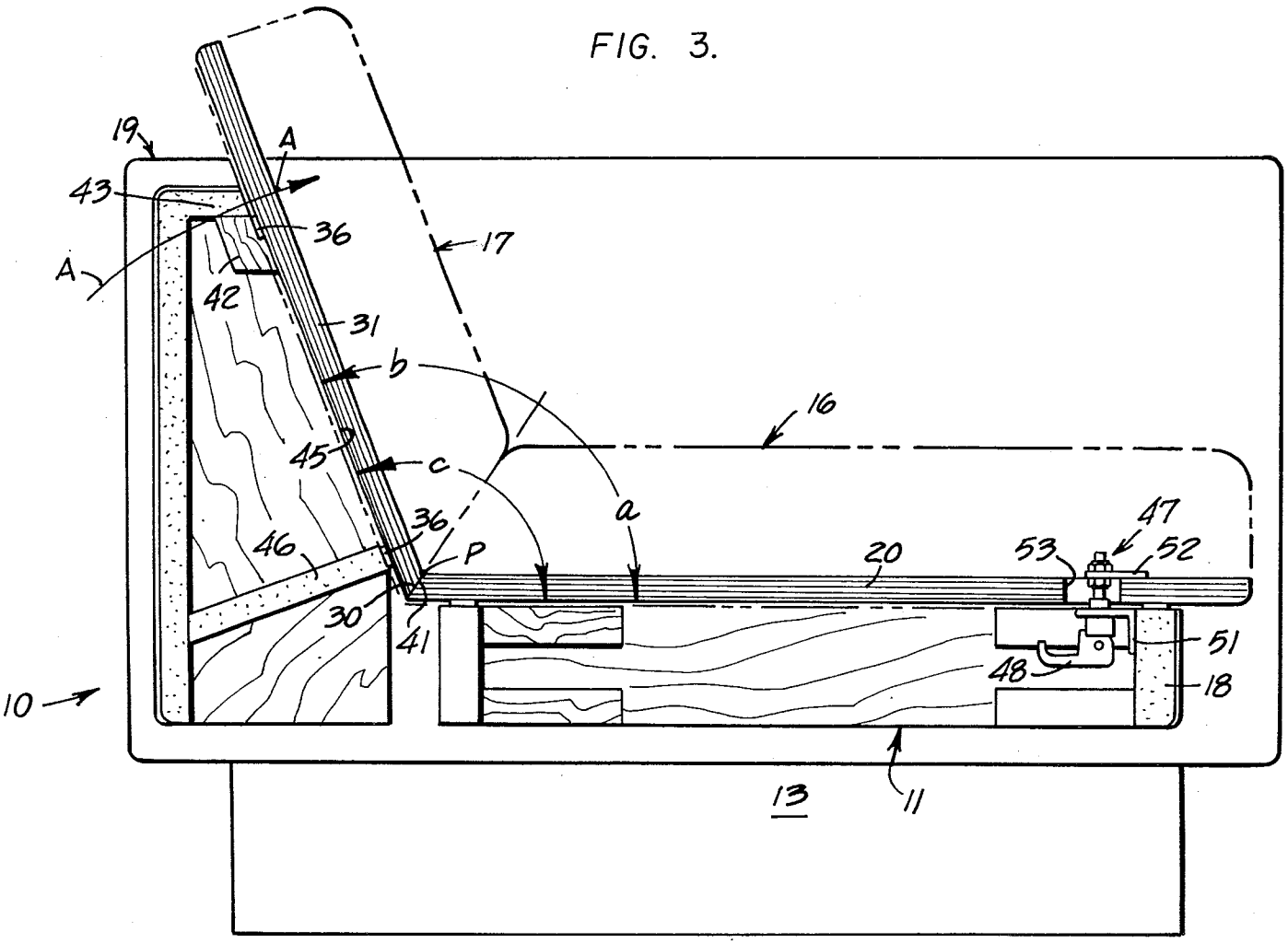
FIG. 3 is an enlarged cross sectional view, taken in the direction of arrows III—III in FIG. 2.

FIGS. 1 and 2 illustrate a furniture construction 10 which may comprise a single chair or a modular construction wherein a plurality of chairs or portions thereof are attached together to form a couch, a back-to-back seating arrangement or the like. Each chair, for example, may comprise a rigid frame 11 supported on a pair of vertically disposed and laterally spaced legs 12 and 13. A pair of arm rails 14 and 15 are secured to the frame, and seat and back cushions 16 and 17, respectively, are mounted between the arm rails and on the frame.

Figure 5:
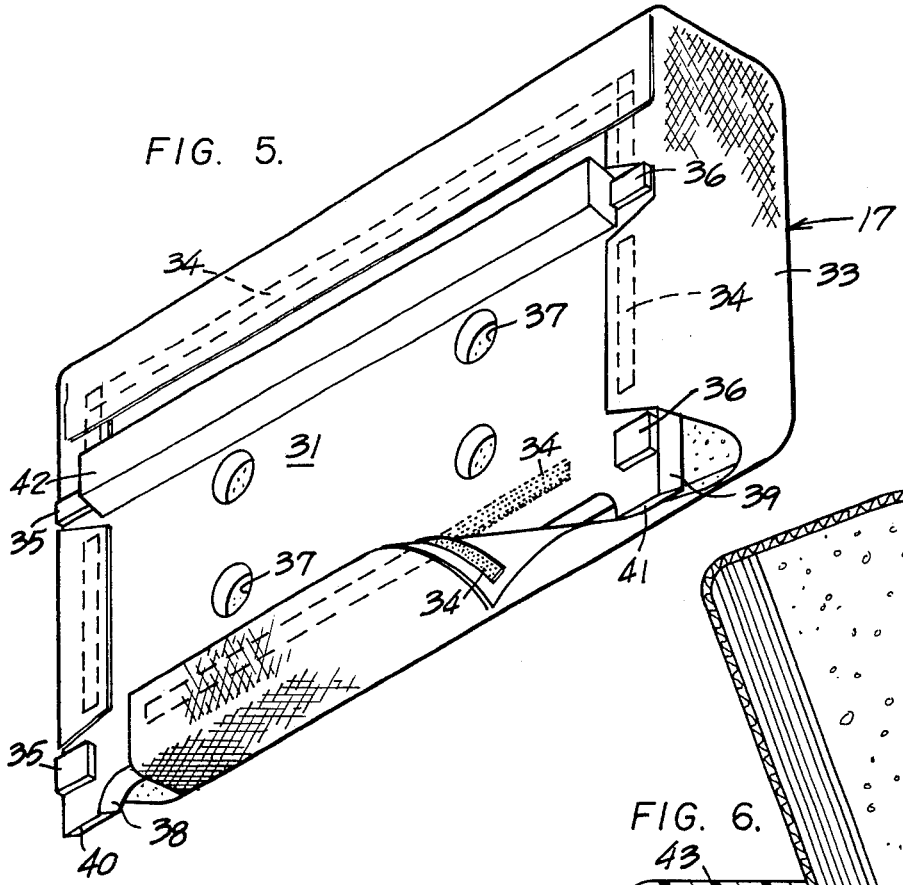
FIG. 5 is an underside perspective view of the seat cushion.

Referring to FIG. 4, frame 11, shown with arm rail 14 removed, comprises a horizontally disposed bottom frame portion 18 and a generally upright back frame portion 19 secured to the bottom frame portion through arm rails 14 and 15. As shown in FIG. 5, seat cushion 16 comprises a flat rigid first support member 20, preferably comprising a laminated plywood construction. The support member provides the backing for a foam rubber or the like filler 21 suitably covered by a fabric 22 and held in place by elastomeric straps 23.

The fabric may be bent-over a back side of the support member and releasably attached thereto by releasable fastening means 24, such as Velcro fasteners of the type disclosed in U.S. Pat. No. 3,353,663. Two pairs of spacer plates 25 and 26, secured to the support, are disposed in cut-outs formed in fabric 22 and have a thickness no greater than the thickness of the fabric 22 to prevent crushing thereof upon installation. A pair of extensions 27 and 28 project rearwardly of the support member and have inclined bearing surfaces 29 and 30 formed thereon, respectively.

Figure 6:
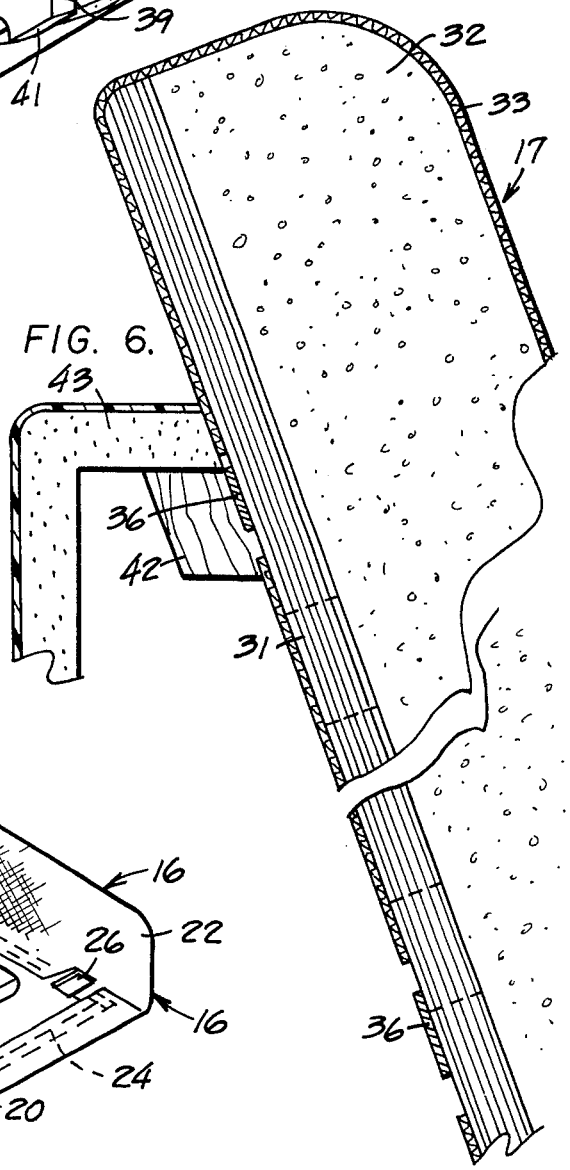
FIG. 6 is a back side perspective view of the back cushion.
Figure 7:
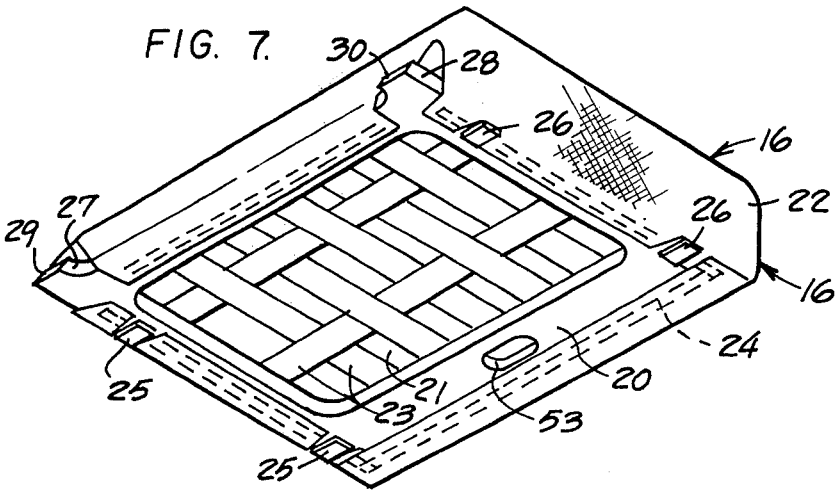
FIG. 7 is an enlarged sectional view disclosing a bearing relationship between the back cushion and the frame.

Referring to FIGS. 6 and 7 back cushion 17 comprises a flat, rigid second support member 31 also preferably comprising a laminated plywood construction. The second support member has a filling material 32 mounted thereon and covered by a fabric 33. The fabric overlaps the peripheral edges of the support member and is releasably attached thereto by releasable fastening means 34, similar to releasable fastening means 24.

Two pairs of spacer means or plates 35 and 36 are secured to a back side of the second support member and have a thickness which is no greater than the thickness of fabric 33 to prevent crushing thereof when the back panel is installed. The support member further comprises vent holes 37 formed therethrough and a pair of extensions 38 and 39, having inclined surfaces 40 and 41 formed thereon, respectively. In addition, a horizontally disposed retaining member 42 is secured on a back side of the second support member. Referring to FIGS. 3 and 7, the back cushion is initially installed to have upper surface portions of a first retaining member 42 abut the underside of a second retaining member 43, formed as an integral part of back frame 19. It should be noted that in the absence of seat cushion 16, that the back cushion would fall of its own accord. When installed, blocks 35 and 36 (FIG. 6) bear against rails 44–46 of the back frame (FIGS. 3, 4 and 7) to prevent crushing of material 33 thereunder and to adapt for varied material thickness.

The back cushion is held in place manually and seat cushion 16 is moved rearwardly to its FIG. 3 position whereat inclined bearing surfaces 29 and 30 thereof abut inclined bearing surfaces 40 and 41, respectively, of the back cushion. As shown in FIG. 3, the common interface thereat forms acute angles a and b with respect to the planes of the respective support members. Included angle c, between the support members, is preferably selected from the range of from 90° to 140° whereas angles *a* and *b* are each preferably selected from the range of from 45° to 70°. Support member 20 is thus positioned to prevent removal of the back cushion upon an attempt to pivot it through arc A, about pivot point P.

The forward end of support member 20 is then secured to frame 11 by a single releasable fastening means 47 which provides the sole mechanical securance of the cushions to the frame. As more clearly shown in FIGS. 8 and 9, such releasable fastening means may comprise a standard "New Southco Adjustable Grip Latch" having a handle 48 pivotally mounted on a shaft 49 by a pin 50. The shaft is rotatably and reciprocally mounted in a bracket 51, secured on bottom frame 18, and the upper end of the shaft has a latching pawl 52 adjustably secured thereon.

The shaft extends upwardly through an oval-shaped aperture 53, formed through the frame. The pawl engages the top surface of support member 20*a* when it assumes its latched position shown by solid lines in FIGS. 3, 8 and 9. Such position remains intact due to the engagement of cam portion 54 of the handle with a bearing surface formed under a boss 55 of bracket 51.

When it is desired to release the seat cushion from the frame, handle 48 is pivoted downwardly to its phantom-line position illustrated in FIG. 8 to release cam 54 from bearing surface 55. The handle and shaft are then moved upwardly and the latching pawl is pivoted 90° to its released position shown by phantom lines in FIG. 9. Thus, the seat cushion may be removed which in turn permits removal of the unattached back cushion solely by release of single fastening means 47.

Figure 10:
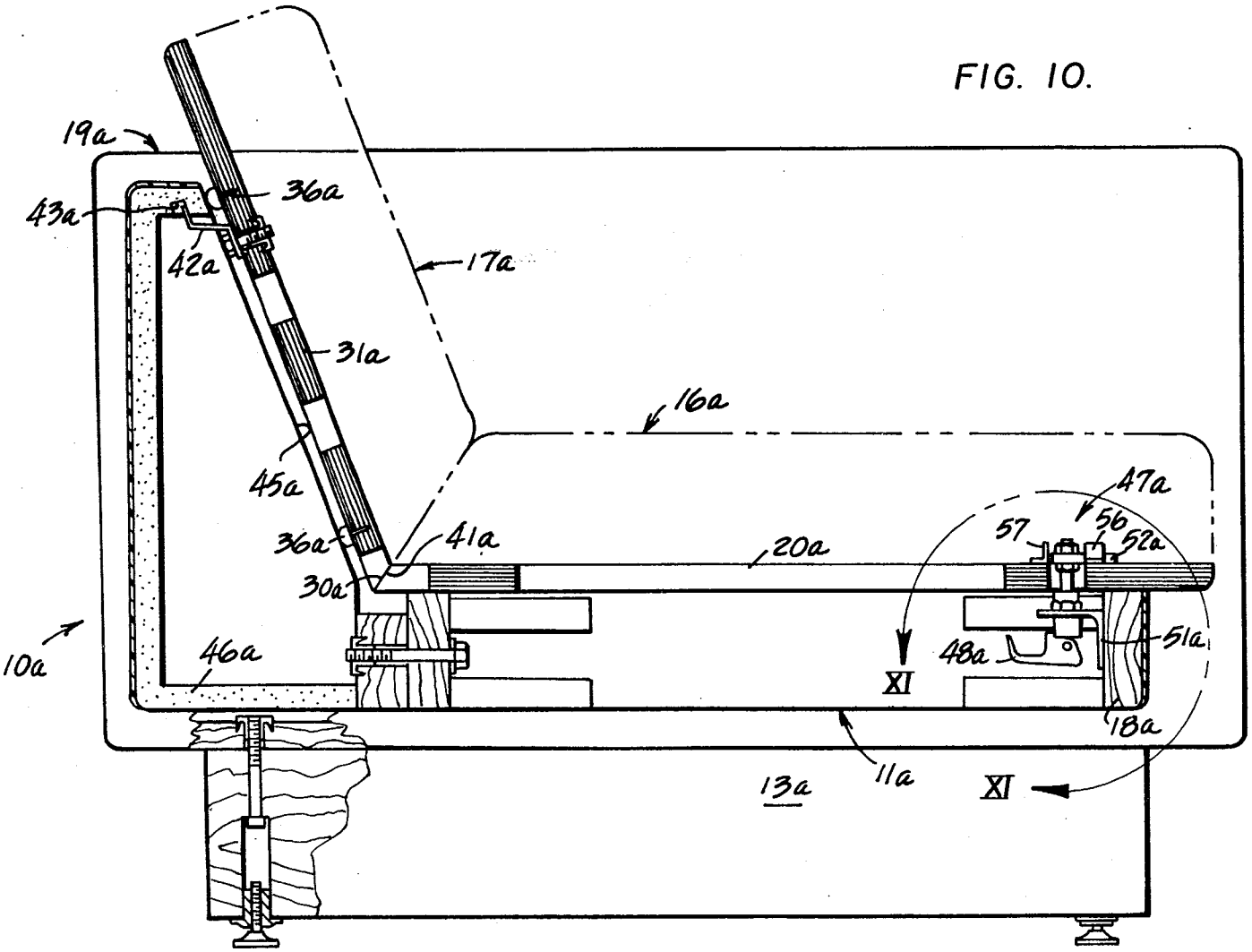
FIGS. 10-12 are views similar to FIGS. 3, 8 and 9, respectively, but illustrating another embodiment of this invention.
Figure 11:
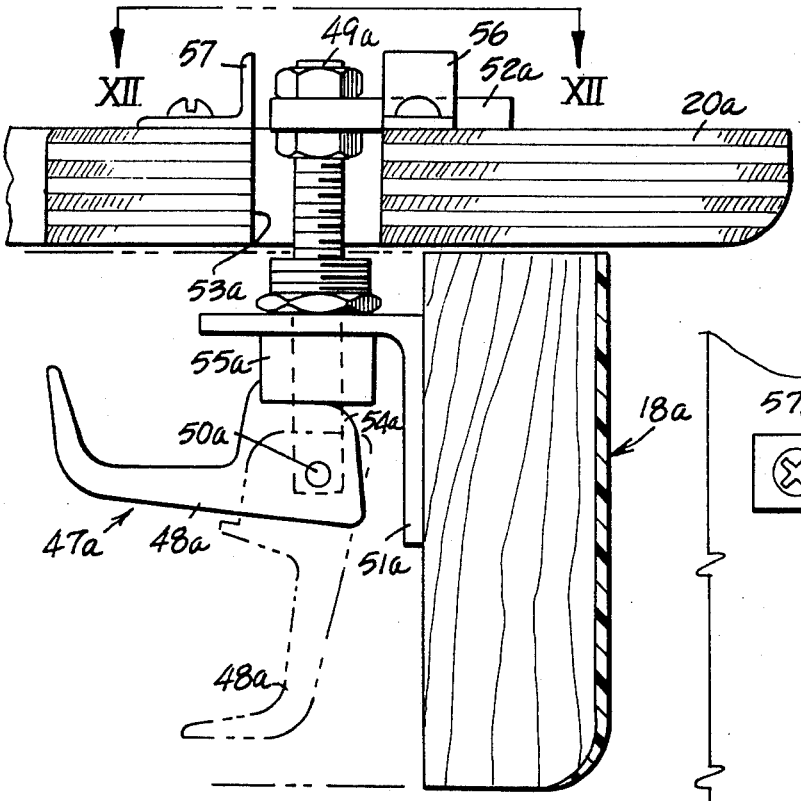
Figure 12:
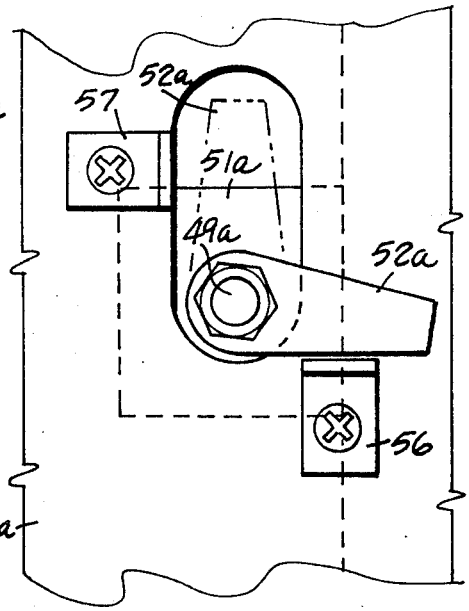

FIGS. 10–12 illustrate another embodiment of this invention wherein identical numerals, each accompanied by an *a*, depict structures corresponding to those shown in FIGS. 1–9. Furniture construction 10*a* comprises a rigid frame 11*a* supported on legs 13*a* (one shown). Seat and back cushions 16 *a* and 17*a* are mounted on bottom and back frame portions 18*a* and 19*a*, respectively.

The seat cushion comprises a first support member 20*a* and has inclined bearing surfaces 30*a* (one shown) formed on a pair of rearward extensions, corresponding to extensions 27 and 28 (FIG.7). The back cushion comprises a second support member 31*a* having two pairs of rubber or plastic spacer means or buttons 36*a* (one pair shown) secured thereon to abut rails 45*a* (one shown). It should be noted that rail or cross-support 46 (FIG. 3) has been relocated to a lower position indicated at 46*a* in FIG. 10.

The lower end of second support member 31*a* has a pair of inclined bearing surfaces 41*a* (one shown) formed on a pair of rearward extensions, corresponding to extensions 38 and 39 (FIG. 5). A first retaining member, such as one or more latch-type brackets 42*a*, is secured to a back side of second support member 31*a*. The retaining member engages a slot 43*a* formed on the underside of a second retaining member which is an integral part of back frame 19*a*.

The forward end of support member 20*a* is also preferably secured to frame 11*a* by a single releasable fastening means 47*a* which provides the sole mechanical securance of the cushions to the frame. As more clearly shown in FIGS. 11 and 12, such fastening means may comprise a latch 47*a* substantially similar to latch 47, namely, a handle 48*a*, a shaft 49*a*, a pin 50*a*, a bracket 51*a*, a latching pawl 52*a*, cam portion 54*a* and a boss 55*a*.

The shaft extends upwardly through an oval-shaped aperture 53*a*, formed through support member 20*a*, to normally dispose latching pawl 52*a* on the top surface of support member 20 when the latch assumes its latched position shown by solid lines. The latch can be released to remove the cushions in the manner explained above. The FIGS. 10–12 latch essentially differs from the one illustrated in FIGS. 8 and 9 in that it is provided with a pair of stops, such as brackets 56 and 57 secured to the top of support member 20*a*, to precisely position the latching pawl between its latched and released (dotted line in FIG. 12) positions.

Figure 13:
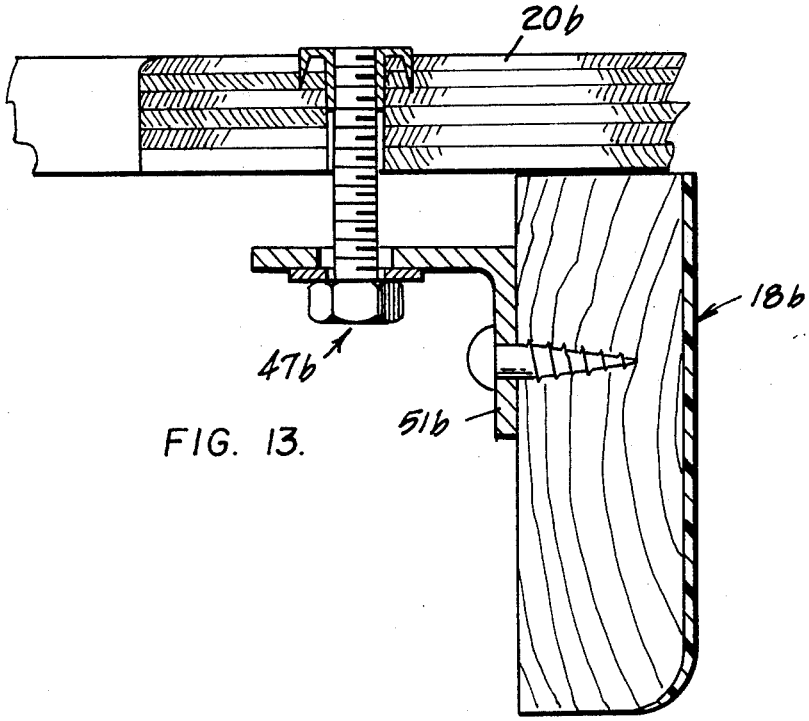
FIG. 13 is a view similar to FIGS. 8 and 11, but illustrating another fastening means embodiment.

FIG. 13 illustrates another fastening means embodiment wherein identical numerals, each accompanied by a *b*, depict structures corresponding to those shown in previous figures. Such fastening means comprises a releasable bolt 47*b* which projects through a bracket 51*b* secured to a bottom frame 18*b* to releasably attach a first support member 20*b* thereto. It should be understood that fastening means 47*b* can be utilized in lieu of or in addition to fastening means 47 or 47*a*.

What is claimed is:

1. A furniture construction comprising a generally horizontally disposed bottom frame, a generally upright back frame secured to said bottom frame, a seat cushion comprising a rigid first support member secured thereunder to overlie and rest on said bottom frame, and a back cushion comprising a rigid second support member secured thereunder to overlie and rest on said back frame in unattached relationship therewith, said back frame having a first retaining member disposed adjacent to an upper end thereof, a second retaining member secured on a back side of said second support member and engaging an underside of said first retaining member in unattached relationship therewith, a lower end of said second support member and a rearward end of said first support member meeting in unattached relationship at at least one common interface, forming an acute angle with respect to the planes of each of said first and second support members, and positioned with respect to said engaged first and second retaining members to prevent removal of said back cushion upon pivoting thereof at said interface toward said seat cushion, and releasable fastening means solely securing said first support member to said bottom frame and solely exposed for release beneath said seat cusion whereby said seat and back cushions can be removed upon release of only said releasable fastening means.

2. The furniture construction of claim 1 wherein a front side of said back cushion is covered with a fabric having its edges bent over a back side of said second support member and further comprising releasable fastening means attaching the edges of said fabric to the back side of said second support member.

3. The furniture construction of claim 2 further comprising spacers, abutting said back frame, secured on said second support member with each spacer being disposed in a cut-out formed in said fabric and having a thickness which is no greater than the thickness of said fabric.

4. The furniture construction of claim 1 wherein a pair of said common interfaces are formed on each one of a pair of laterally spaced extensions formed integrally with each of said first and second support members.

5. The furniture construction of claim 1 wherein the included angle between the planes of said first and second support members is selected from the range of from 90° to 140°.

6. The furniture construction of claim 1 wherein the included angle between said interface and the plane of each of said first and second support members is selected from the range of from 45° to 70°.

7. The furniture construction of claim 1 wherein said releasable fastening means comprises a releasable clamping device mounted on a forward end of said bottom frame to normally engage a top surface of said first support member to clamp it to said bottom frame.

8. The furniture construction of claim 7 wherein said clamping device comprises a handle pivotally mounted on a shaft extending upwardly through an aperture formed through said first support member, said shaft rotatably and reciprocally mounted on a bracket secured to said bottom frame and having a latching pawl secured thereon to normally engage the top surface of said first support member.

9. The furniture construction of claim 8 further comprising stop means secured on the top surface of said first support member for precisely positioning said latching pawl between its normally engaged position and a released position.

10. The furniture construction of claim 1 wherein said releasable fastening means comprises a releasable bolt.

11. The furniture construction of claim 1 wherein said first retaining member has a slot formed thereunder and said second retaining member comprises a latch-type bracket secured to said second support member and normally engaging said slot.

12. In a furniture construction comprising a generally horizontally disposed bottom frame secured to a generally upright back frame and seat and back cushions respectively having first and second rigid support members mounted on said bottom and back frames, respectively, the invention comprising releasable fastening means solely securing said first support member on said bottom frame, said second support member mounted on said back frame in unattached relationship therewith, and means cooperating in unattached relationship between said second support member and said first support member and said back frame for preventing removal of said back cushion upon pivoting thereof toward said seat cushion whereby said seat and back cushions can be removed from their respective bottom and back frames upon release of only said releasable fastening means.

* * * * *